United States Patent [19]

Phillips

[11] 4,441,517

[45] Apr. 10, 1984

[54] APPARATUS FOR SONICALLY FACILITATING THE CLEANING OF OIL STORAGE AND TRANSPORT VESSELS

[75] Inventor: Edward H. Phillips, Middletown, Calif.

[73] Assignee: Hidden Valley Associates, Middletown, Calif.

[21] Appl. No.: 408,053

[22] Filed: Aug. 13, 1982

[51] Int. Cl.[3] ..... B08B 3/12

[52] U.S. Cl. ..... 134/113; 134/166 R; 134/184

[58] Field of Search ..... 134/1, 113, 166 R, 184

[56] References Cited

U.S. PATENT DOCUMENTS 3,001,769 9/1961 Plassmeyer ..... 134/1 X
3,021,119 2/1962 Van Der Burgt ..... 134/1 X
3,210,052 10/1965 Gaal ..... 134/184 X
4,120,699 10/1978 Kennedy, Jr. et al. ..... 134/1

FOREIGN PATENT DOCUMENTS 647020 2/1979 U.S.S.R. ..... 134/184

*Primary Examiner*—Robert L. Bleutge
*Attorney, Agent, or Firm*—Roland I. Griffin

[57] ABSTRACT

One or more sonic transducer arrays disposed outside an oil storage or transport vessel are each acoustically coupled through a wall of the vessel to sludge or other such material formed in the vessel and to a cleaning agent introduced into the vessel. Each sonic transducer array is scanned to direct a beam of sonic energy into the storage or transport vessel through a wall thereof in a manner such that all portions of the sludge or other such material and the cleaning agent are cyclically irradiated by sonic energy.

9 Claims, 13 Drawing Figures

APPARATUS FOR SONICALLY FACILITATING THE CLEANING OF OIL STORAGE AND TRANSPORT VESSELS

BACKGROUND OF THE INVENTION

This invention relates to a method and apparatus for sonically breaking up layers of sludge or other such material in an oil storage or transport vessel to facilitate the formation of an emulsion that can readily be removed from the oil storage or transport vessel. More particularly, this invention relates to a method and apparatus for introducing sonic energy into the oil storage or transport vessel through the walls thereof to break up the layers of sludge or other such material and facilitate the formation of the emulsion.

Sludge or other such material formed in oil storage vessels, such as oil storage tanks, or in oil transport vessels, such as oil tankers or barges, is typically removed to facilitate repair of the oil storage or transport vessels, to reclaim petroleum from the sludge or other such material, or to restore the full storage capacity of the oil storage or transport vessels. Conventionally, sludge or other such material is manually removed from oil storage or transport vessels. Such manual removal is dangerous, time consuming, wasteful and environmentally hazardous.

It is accordingly the principal object of this invention to provide a method and apparatus that eliminates the need for manually removing sludge or other such material from oil storage or transport vessels and that concomitantly overcomes the disadvantages of manual removal.

Another object of this invention is to provide a method and apparatus for introducing sonic energy into oil storage or transport vessels through the walls thereof to facilitate nonmanual removal of sludge or other such material formed in those vessels.

Still another object of this invention is to provide a method and apparatus for introducing sonic energy into oil storage or transport vessels through the walls thereof without the necessity of placing sonic transducers in physical contact with the walls of the vessels and without structurally altering or affecting the vessels.

These and other objects of this invention, which will become apparent from a reading of the following specification and an inspection of the accompanying drawings, are accomplished according to the illustrated preferred embodiments of this invention by acoustically coupling one or more sonic transducer arrays disposed outside an oil storage or transport vessel to sludge or other such material formed in the vessel and to a cleaning agent introduced into the vessel. Each sonic transducer array is mechanically or electronically scanned to direct a beam of sonic energy into the storage or transport vessel through a wall thereof in a manner such that all portions of the sludge or other such material and the cleaning agent contained in the vessel are cyclically radiated by sonic energy. This progressively breaks up layers of the sludge or other such material formed in the oil storage or transport vessel and thereby facilitates formation of an emulsion that can readily be pumped out of the vessel. Each sonic transducer array may be supported out of physical contact with the oil storage or transport vessel and within a fluid acoustically coupled to the sludge or other such material and the cleaning agent contained in the vessel by a housing releasably mechanically coupled to a wall of the vessel.

DESCRIPTION OF THE PREFERRED EMBODIMENTS

Figure 2:
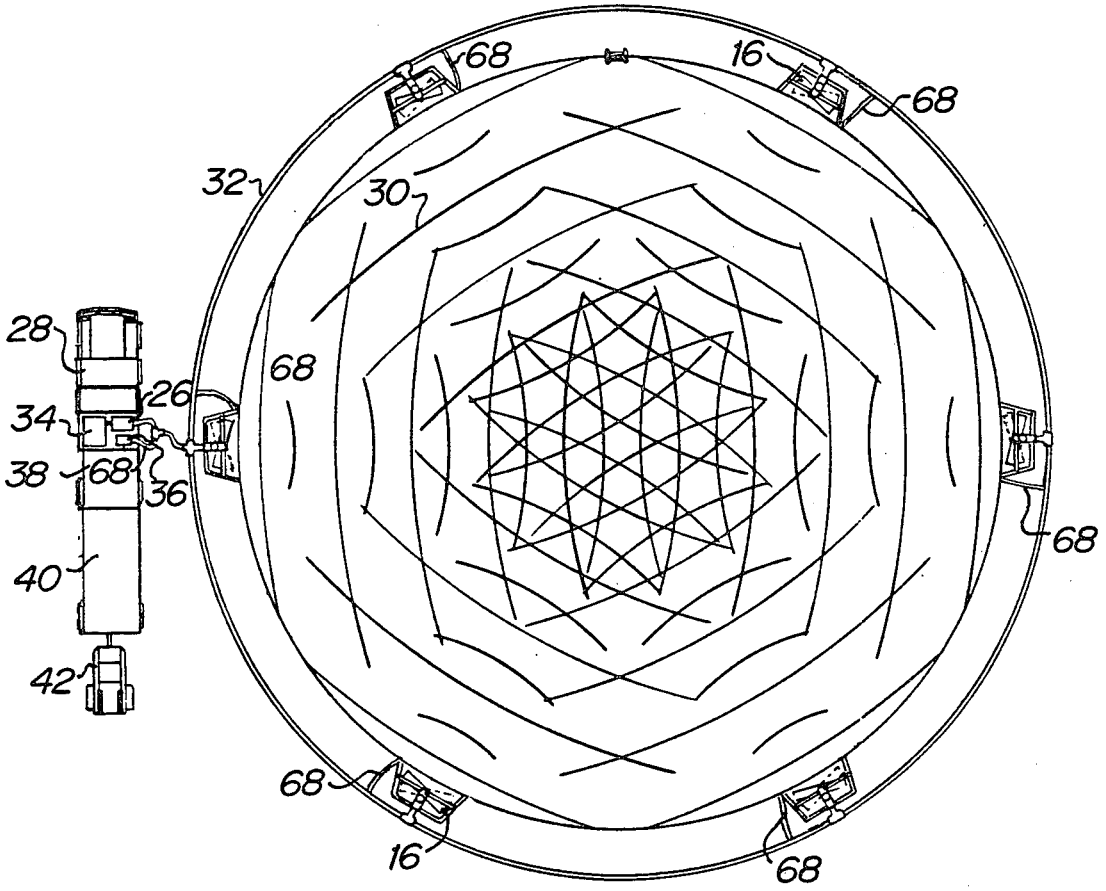
FIG. 2 is a sectional plan view of the oil storage tank and the sonic apparatus of FIG. 1 taken along the section line 2—2, together with a service truck that may be employed with the sonic apparatus.
Figure 1:
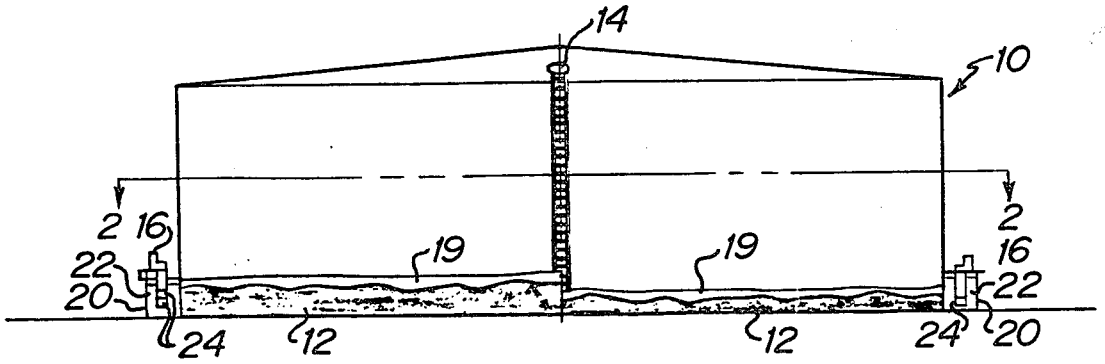
FIG. 1 is a sectional elevational view of an oil storage tank having sludge or other such material formed therein as illustrated for two different stages and of sonic apparatus employed to facilitate removal of the sludge or other such material in accordance with a preferred embodiment of this invention.

Referring now to FIGS. 1 and 2, there is shown an oil storage tank 10 having sludge 12 or other such material formed in the bottom thereof as depicted at two different stages in the formation of the sludge by a deeper formation on the left side and a shallower formation on the right side of FIG. 1. In order to facilitate repair of the oil storage tank 10, to reclaim petroleum from the sludge 12, to restore the full storage capacity of the oil storage tank, or for some other reason, it is desirable to remove the sludge from the oil storage tank. This cannot effectively be done through an access opening 14 typically provided in the top or side of the oil storage tank 10 due to the relatively small size of the access opening and due to the danger in entering the oil storage tank to attempt manual removal of the sludge. According to a preferred embodiment of the present invention for permitting safe, relatively fast removal of the sludge 12 from the oil storage tank 10 without cutting a large access opening in the side of the oil storage tank and without otherwise altering or affecting the oil storage tank and, hence, with little or no waste and little or no hazard to the environment, six sonic transducer assemblies 16 are symmetrically arranged at sixty degree intervals around the outer wall 18 of the oil storage tank and vertically adjacent to the sludge 12 formed in the oil storage tank. Concomitantly, a cleaning agent 19, such as a biopolymer emulsifier (emulsan) obtained from Petroferm USA of Amelia Island, Florida and mixed with water is introduced into the oil storage tank 10 through the access opening 14 so as to cover the sludge 12.

Each of the sonic transducer assemblies 16 comprises a housing 20 releasably secured to the outer wall 18 of the oil storage tank 10 so as to form a reservoir for holding an acoustic coupling fluid 22, such as water, introduced into the reservoir through an open top portion thereof. In addition, each of the sonic transducer assemblies 16 comprises one or more immersion-type sonic transducer arrays 24, such as may be obtained from Lewis Corporation of Woodbury, Connecticut, supported by the corresponding housing 20 in the acoustic coupling fluid 22 contained within the reservoir formed by that housing with the outer wall 18 of the oil storage tank 10. Although a single immersion-type sonic transducer array 24, as shown for the shallower formation of sludge 12 on the right side of FIG. 1, is normally sufficient, two or more immersion-type sonic transducer arrays may be vertically stacked to effectively increase the sonic power available for deeper formations of sludge, as shown on the left side of FIG. 1.

Each of the immersion-type sonic transducer arrays 24, which is acoustically coupled to the sludge 12 and to the cleaning agent 19 via the coupling fluid 22 and the wall 18 of the oil storage tank 10, is electrically driven, such as by an inverter 26 mounted on a service truck 28, so as to direct a beam of sonic energy into the oil storage tank. In addition, each of the immersion-type sonic transducer arrays 24 is mechanically driven so as to scan the beam of sonic energy emanating therefrom plus or minus fifteen degrees, as shown by the curved scan lines 30 in FIG. 2. This completely irradiates all portions of the sludge 12 and the cleaning agent 19 inside the oil storage tank 10 with sonic energy, as shown by the overlapping curved scan lines 30 in FIG. 2. Such sonic irradiation progressively breaks up surface layers of the sludge 12 thereby facilitating formation of an emulsion of the sludge and the cleaning agent. This emulsion can readily be pumped out of the oil storage tank 10 through the access opening 14 and removed from the site of the oil storage tank.

The service truck 28 may include an umbilical service cable 32 for supplying power from a motor-generator set 34 and the inverter 26 to each of the sonic transducer assemblies 16. In addition, the service truck 28 may further include a vacuum pump 36 for use in securing the sonic transducer assemblies 16 to the outer wall 18 of the oil storage tank 10 as hereinafter described, a laboratory and control room 38 for chemical analysis and system control, a storage space 40 for the aforementioned apparatus and materials, and provision for towing a smaller materials handling truck 42 that may be employed in transporting the aforementioned apparatus and materials between the service truck and the oil storage tank.

Figure 3:
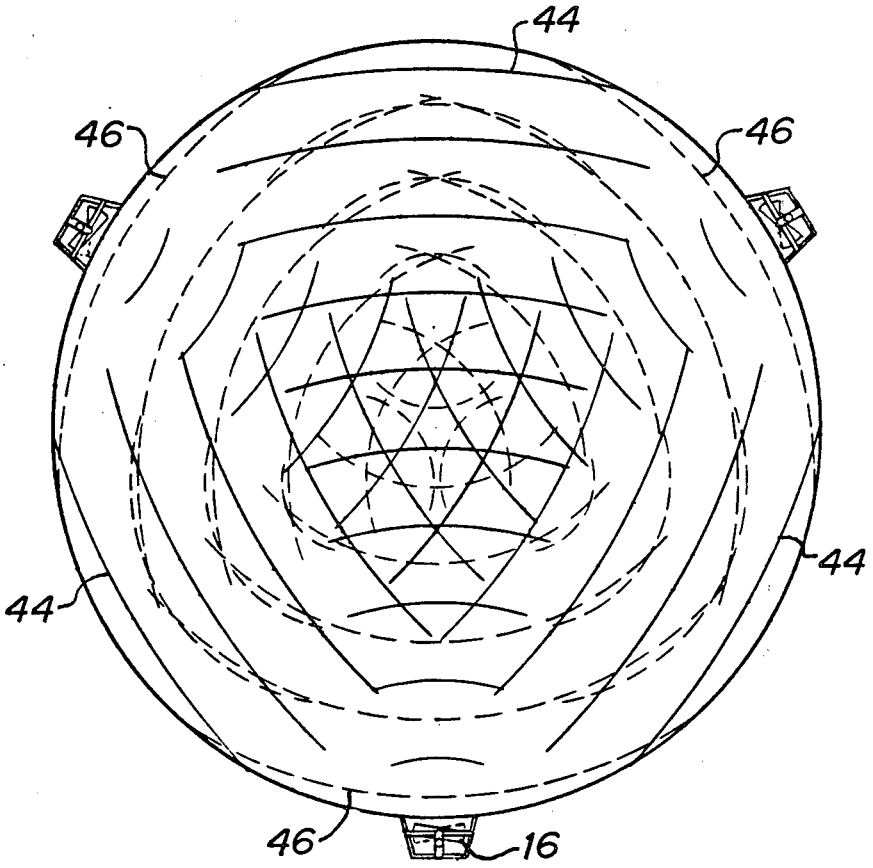
FIG. 3 is another sectional plan view of the oil storage tank of FIG. 1 and of sonic apparatus employed in accordance with another preferred embodiment of this invention.
Figure 4:
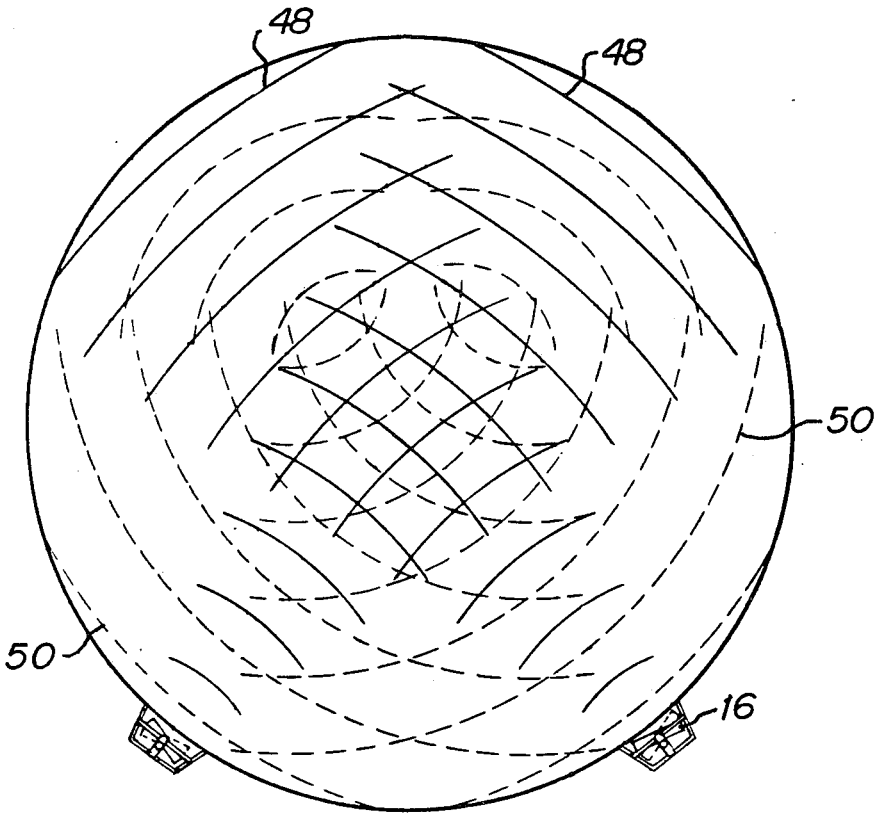
FIG. 4 is another sectional plan view of the oil storage tank of FIG. 1 and of sonic apparatus employed in accordance with another preferred embodiment of this invention.
Figure 5:
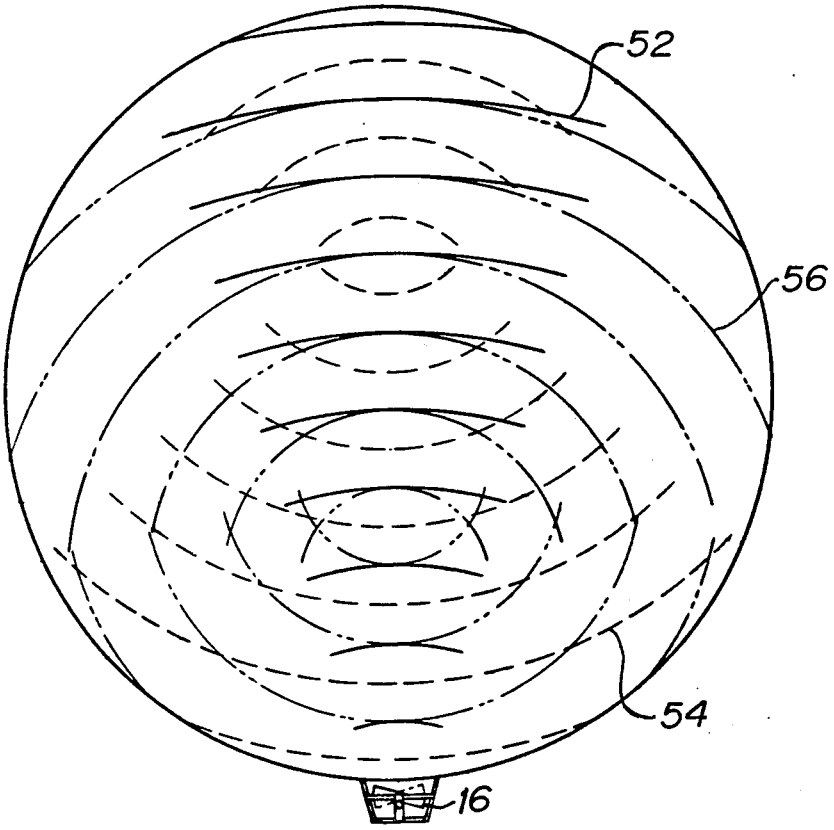
FIG. 5 is still another sectional plan view of the oil storage tank of FIG. 1 and of sonic apparatus employed in accordance with still another preferred embodiment of this invention.

According to other preferred embodiments of this invention different numbers and arrangements of sonic transducer assemblies 16 may be employed, as shown, for example, in FIGS. 3, 4 and 5. Thus, three sonic transducer assemblies 16 may be symmetrically arranged at one hundred twenty degree intervals around the outer wall 18 of the oil storage tank 10, as shown in FIG. 3. Each of these three sonic transducer assemblies 16 is also mechanically driven so as to scan the beam of sonic energy emanating therefrom plus or minus fifteen degrees, as shown by the solid curved scan lines 44 in FIG. 3. Although these three scanned beams of sonic energy do not directly fully irradiate all portions of the sludge 12 and the cleaning agent 19 within the oil storage tank 10, primary reflections of these three scanned beams do fully irradiate all portions of the sludge and the cleaning agent, as shown by the overlapping dashed curved scan lines 46 in FIG. 3.

Two sonic transducer assemblies 16 may be spaced seventy-seven degrees apart on the outer wall 18 of the oil storage tank 10, as shown in FIG. 4. Each of the these two sonic transducer assemblies 16 is also mechanically driven so as to scan the beam of sonic energy emanating therefrom plus or minus fifteen degrees, as shown by the solid curved scan lines 48 in FIG. 4. Although these two scanned beams of sonic energy also do not directly fully irradiate all portions of the sludge 12 and the cleaning agent 19 within the oil storage tank 10, primary reflections of these two scanned beams do fully irradiate all portions of the sludge and the cleaning agent, as shown by the dashed curved scan lines 50 in FIG. 4.

Even a single sonic transducer assembly 16 may be employed, as shown in FIG. 5. This sonic transducer assembly 16 is also mechanically driven so as to scan the beam of sonic energy emanating therefrom plus or minus fifteen degrees, as shown by the solid curved scan lines 52 in FIG. 5. Although neither this scanned beam of sonic energy nor its primary reflection, as shown by the dashed curved scan lines 54 in FIG. 5, fully irradiates all portions of the sludge 12 and the cleaning agent 19 within the oil storage tank 10, the secondary reflection of this scanned beam does fully irradiate all portions of the sludge and the cleaning agent, as shown by the broken curved scan lines 56 in FIG. 5.

Figure 7:
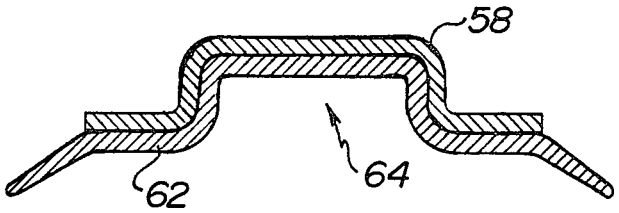
FIG. 7 is a cross-sectional view of the sealing flange portion of the scanning sonic transducer assembly of FIG. 6 taken along the section line 7—7.
Figure 6:
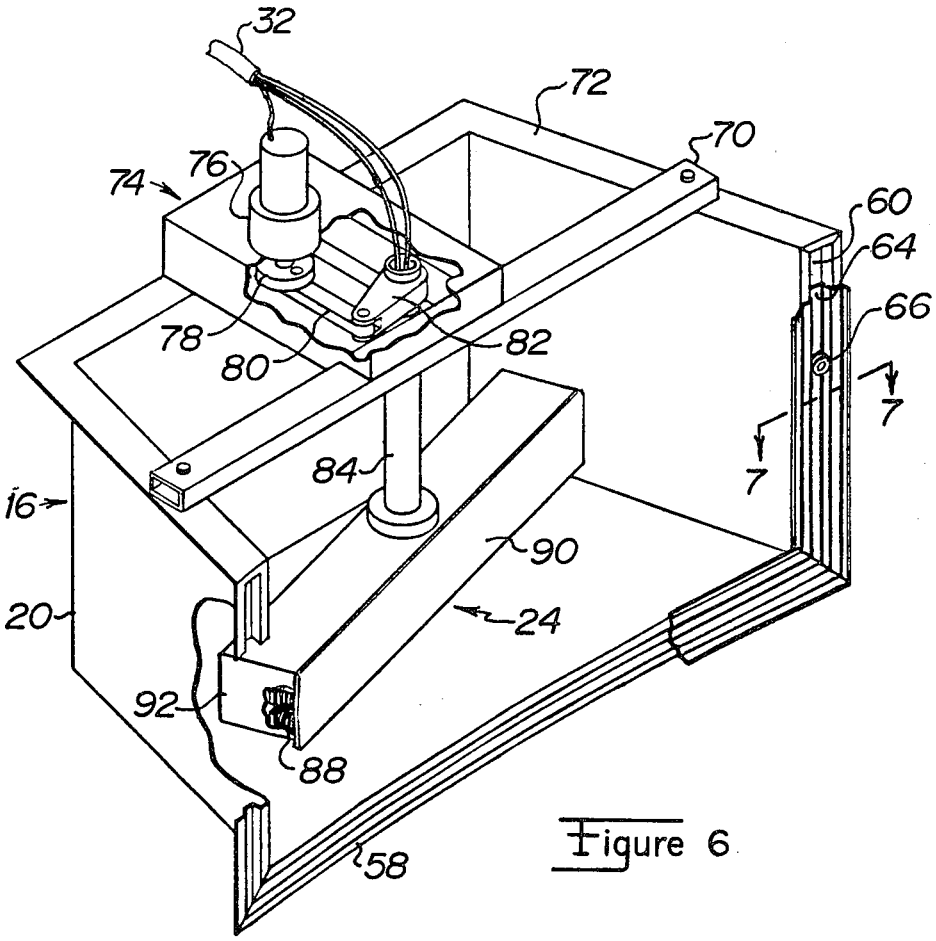
FIG. 6 is a sectional isometric view of a scanning sonic transducer assembly employed in the sonic apparatus of FIGS. 1 through 5.

Referring to FIG. 6, there is shown a detailed view of one of the sonic transducer assemblies 16 employed in the previously-described preferred embodiments of this invention. As previously described, the sonic transducer assembly 16 includes a housing 20 and an immersion-type sonic transducer array 24. As shown in FIGS. 6 and 7, the housing 20 has a mounting flange 58 with a recess 60 formed therein adjacent to an open side portion of the housing and further has a relatively soft (for example, thirty-five durometer) rubber sealing member 62 bonded to the surface of the mounting flange. The sealing member 62 forms a vacuum chamber 64 with the outer wall 18 of the oil storage tank 10. This vacuum chamber 64 is coupled to the vacuum pump 36 of the service truck 28 via a fitting 66 and a vacuum line 68 included in the umbilical cable 32, as shown in FIG. 2. Thus, the housing 20 may be releasably secured to the outer wall 18 of the oil storage tank 10 by drawing a vacuum through the vacuum line 68 and may be supported in place by means of support blocks (not shown).

A support bar 70 is fixedly secured at opposite ends thereof to a stiffening flange 72 of the housing 20 adjacent to the open top portion of the housing. The support bar 70 and the stiffening flange 72 fixedly support a mechanical drive unit 74 including a gear motor 76, an eccentric member 78 coupled to an output shaft of the gear motor for rotation therewith, and a rod 80 rotatably coupled at one end to the eccentric member and rotatably coupled at the other end to one end of a crank 82. A cylindrical tube 84 is fixedly coupled at its upper end to the other end of the crank 82 and is rotatably supported by a bearing unit (not shown) included in an enclosure 86 of the drive unit 74. The cylindrical tube 84 is fixedly coupled at its lower end to the immersion-type sonic transducer array 24, which may comprise parallel rows of magnetostrictive transducer 88 brazed to a stainless steel diaphragm 90 and sealed within an enclosure 92 fixedly secured in water-tight engagement with the stainless steel diaphragm. Eccentric member 78 and crank 82 are proportioned to mechanically drive the immersion-type sonic transducer array 24 plus or minus fifteen degrees as the eccentric rotates. The gear motor 76 and the magnetostrictive tranducers 88 are electrically coupled to the motor-generator set 34 of the service truck 28 by the umbilical cable 32, as shown in FIGS. 2 and 6.

Figure 8A:
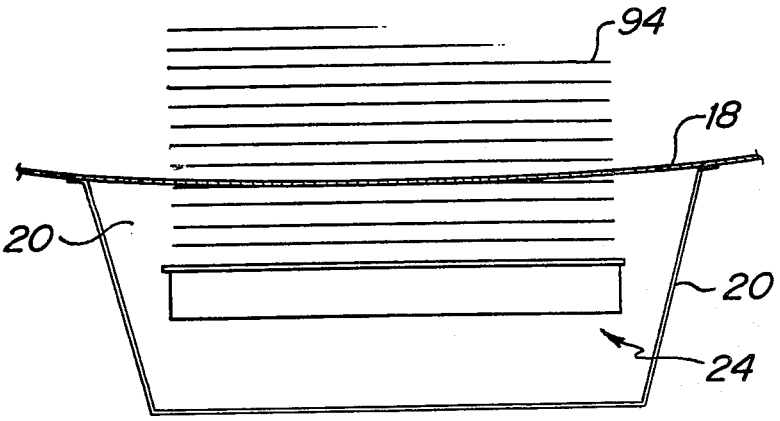
FIGS. 8A and 8B are wavefront diagrams illustrating transmission of a sonic beam directed through a wall of the storage tank of FIGS. 1 through 5 by a single-phase sonic transducer array of the sonic apparatus of FIGS. 1 through 6 for two different positions of the single-phase sonic transducer array.

The manner in which the beam of sonic energy emanating from each of the mechanically-scanned, immersion-type sonic transducer arrays 24 propagates through the acoustic coupling fluid 22 and the adjoining outer wall 18 of the oil storage tank 10 is illustrated in FIG. 8A for an incident beam angle of zero degrees. In order to achieve efficient transmission of the beam of sonic energy through the outer wall 18 of the oil storage tank 10, the frequency of the beam of sonic energy is selected such that the thickness of the outer wall of the storage tank is smaller than a quarter wavelength of the beam of sonic energy where the wavelength of the beam is represented by the spacing between the wavefront propagation lines 94 of FIG. 8A.

Figure 8B:
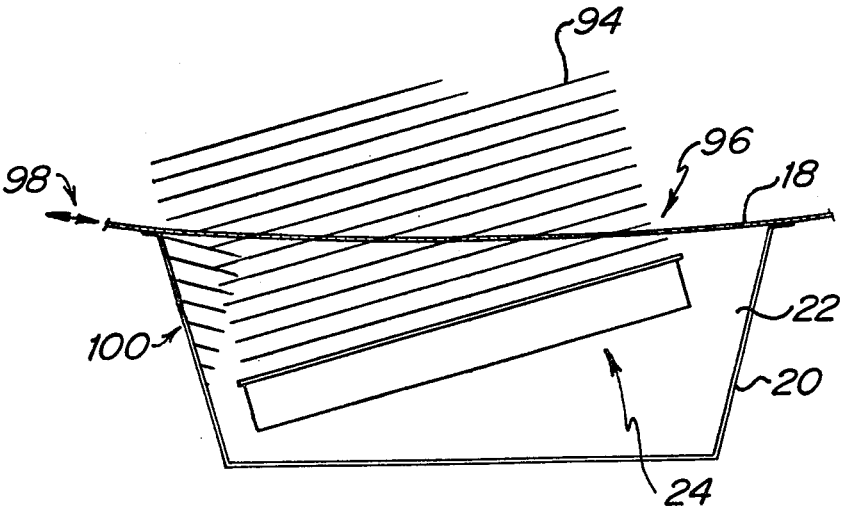

The manner in which the beam of sonic energy emanating from each of the mechanically-scanned, immersion-type sonic transducer arrays 24 propagates through the acoustic coupling fluid 22 and the adjoining outer wall 18 of the oil storage tank 10 is illustrated in FIG. 8B for an incident beam angle of fifteen degrees. Since the speed of sound is greater in the outer (metallic, for example, steel) wall 18 of the oil storage tank 10 than in the adjoining acoustic coupling fluid 22, there is a refractive offset in the wavefront of the beam of sonic energy as it passes through the outer wall of the oil storage tank as illustrated at 96 in FIG. 88. Moreover, due to the progressively increasing angle of beam incidence in the direction toward which the immersion-type sonic transducer array 16 is pivoted, the aforementioned refractive offset increases in the same direction so that a portion of the beam of sonic energy is coupled into a surface wave within the outer wall of the oil storage tank 10, as illustrated at 98 in FIG. 8B, an so that another portion of the beam is reflected back into the acoustic coupling medium 22, as further illustrated at 100 in FIG. 8B. The surface wave has the beneficial effect of facilitating wetting of a larger area of the inner surface of the wall 18 of the oil storage tank 10 with the cleaning agent 19.

Figure 9A:
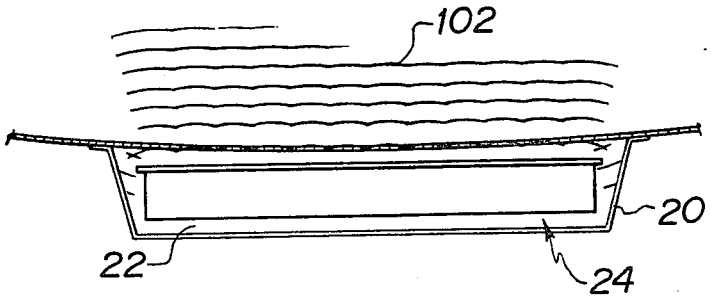
FIGS. 9A and 9B are wavefront diagrams illustrating transmission of a sonic beam directed through a wall of the storage tank of FIGS. 1 through 5 by a variable-phase sonic transducer array of the sonic apparatus of FIGS. 1 through 6 for two different phase relationships of the variable-phase sonic transducer array.
Figure 9B:
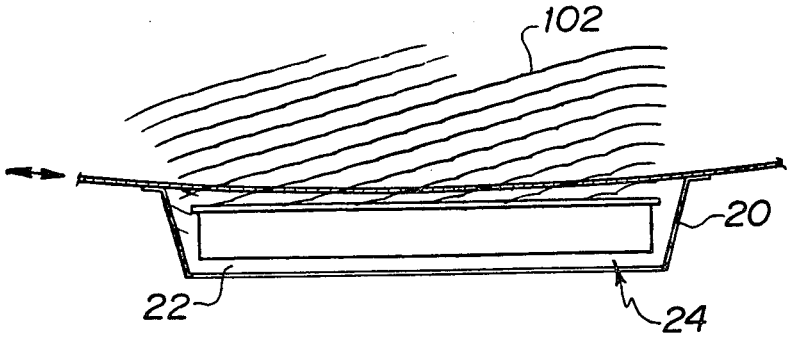

In accordance with another preferred embodiment of this invention, each of the immersion-type sonic transducer arrays 24 may be electronically driven by a plurality of inverters 26 (such as that shown in FIG. 2) each connected to selected groups of one or more of the individual magnetostrictive transducers of the immersion-type sonic transducer array to energize those groups of one or more individual magnetostrictive transducers in a variable-phase sequence. This has the effect of electronically scanning the beam of sonic energy emanating from each immersion-type sonic transducer array 24 as shown by the composite wavefront propagation lines 102 of FIGS. 9A and 9B.

Figure 10:
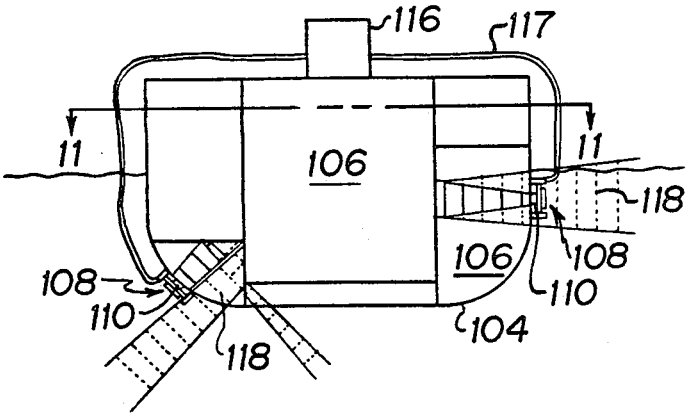
FIG. 10 is a sectional elevational view of an oil tanker and of sonic apparatus employed to facilitate removal of sludge or other such material from the oil tanker in accordance with a further preferred embodiment of this invention.
Figure 11:
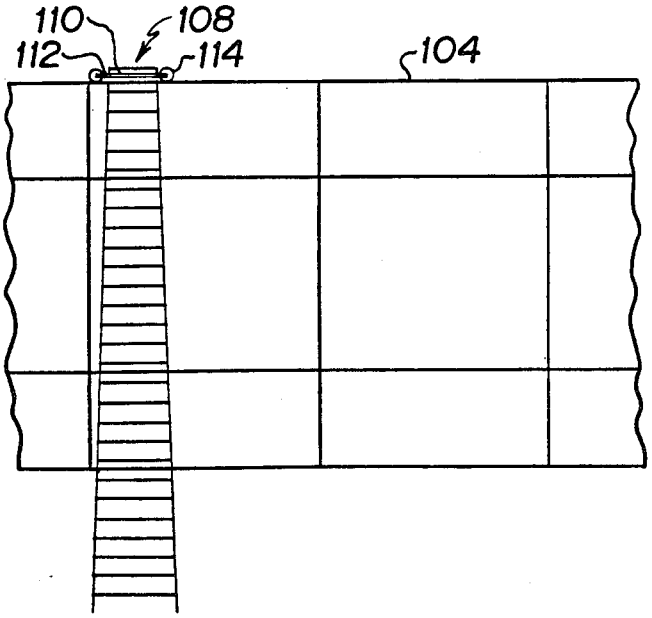
FIG. 11 is a sectional plan view of the oil tanker and the sonic apparatus of FIG. 10 taken along the section line 11—11.

Referring now to FIGS. 10 and 11, there is shown an oil tanker 104 including a plurality of separate oil storage compartments 106 and two sonic transducer assemblies 108 constructed according to still another preferred embodiment of this invention. Each of these sonic transducer assemblies 108 comprises an immersion-type sonic transducer array 110 mounted on a carriage 112, which is in turn magnetically coupled to the hull of the oil tanker 104 and supported for translational movement along the hull by wheels 114. Each carriage 112 is motor-driven to permit mechanical scanning of the submerged portion of the hull of the oil tanker 104. A control unit 116 including an invertor is mounted on the deck of the oil tanker 104 and coupled by an umbilical service cable 117 to each of the sonic transducer assemblies 108 for controlling the movement of each motor-driven carriage 112 and for energizing the corresponding immersion-type sonic transducer array 110 to irradiate each oil storage compartment with sonic energy as the carriage scans past that oil storage compartment. The propagation and reflections of the wavefront of the beam of sonic energy from each immersion-type sonic transducer array 110 are depicted by the wavefront lines 118 in FIGS. 10 and 11.

I claim:

1. Apparatus for directing sonic energy into a vessel, said apparatus comprising:

sonic transducer means, disposed outside the vessel, for directing one or more beams of sonic energy into the vessel; and scan control means, coupled to the sonic transducer means, for scanning said one or more beams of sonic energy to cyclically irradiate nongaseous materials in the vessel.

2. Apparatus as in claim 1 wherein said sonic transducer means comprises one or more immersion-type sonic transducer arrays each adapted for being acoustically coupled to the nongaseous materials in the vessel to direct a beam of sonic energy into the vessel through a wall of the vessel.

3. Apparatus as in claim 2 wherein said scan control means comprises mechanical drive means, coupled to each of the immersion-type sonic transducer arrays, for mechanically scanning the beam of sonic energy emanating therefrom to cyclically irradiate nongaseous materials in the vessel.

4. Apparatus as in claim 3 wherein said mechanical drive means is operable for pivoting each of the immersion-type sonic transducer arrays to mechanically scan the beam of sonic energy emanating therefrom.

5. Apparatus as in claim 4 wherein said sonic transducer means further comprises one or more housings each adapted for supporting an associated one of the immersion-type sonic transducer arrays in a coupling fluid and for being releasably mechanically coupled to a wall of the vessel to support the associated immersion-type sonic transducer array out of physical contact with the vessel but acoustically coupled to the vessel via the coupling fluid.

6. Apparatus as in claim 3 wherein said mechanical drive means is operable for translating each of the immersion-type sonic transducer arrays along the vessel to mechanically scan the beam of sonic energy emanating therefrom.

7. Apparatus as in claim 2 wherein said scan control means comprises electronic drive means, coupled to each of the immersion-type sonic transducer arrays, for electronically scanning the beam of sonic energy emanating therefrom to cyclically irradiate nongaseous materials in the vessel.

8. Apparatus as in claim 7 wherein said sonic transducer means further comprises one or more housings each adapted for supporting an associated one of the immersion-type sonic transducer arrays in a coupling fluid and for being releasably mechanically coupled to a wall of the vessel to support the associated immersion-type sonic transducer array out of physical contact with the vessel but acoustically coupled to the vessel via the coupling fluid.

9. Apparatus as in any of the preceding claims 1 through 8 wherein:

said vessel is an oil storage or transport vessel; and said one or more beams of sonic energy are directed into the oil storage or transport vessel to facilitate removal of sludge or other such nongaseous material from the oil storage or transport vessel.

* * * * *